US007126483B2

(12) United States Patent
Zarouri

(10) Patent No.: US 7,126,483 B2
(45) Date of Patent: Oct. 24, 2006

(54) DEVICE AND METHOD FOR PREVENTING UPPER RESPIRATORY DISEASES AND FOR MODIFYING CERTAIN OCD BEHAVIORS

(76) Inventor: Mourad Zarouri, 14353 Breezeway Pl., San Diego, CA (US) 92128

( * ) Notice: Subject to any disclaimer, the term of this patent is extended or adjusted under 35 U.S.C. 154(b) by 0 days.

(21) Appl. No.: 10/776,730

(22) Filed: Feb. 10, 2004

(65) Prior Publication Data

US 2004/0160326 A1 Aug. 19, 2004

Related U.S. Application Data

(60) Provisional application No. 60/446,901, filed on Feb. 12, 2003.

(51) Int. Cl.
*G08B 23/00* (2006.01)

(52) U.S. Cl. ..... 340/573.1; 340/539.23; 340/573.3

(58) Field of Classification Search ..... 340/573.1, 340/539.11, 539.23, 573.3; 607/63
See application file for complete search history.

(56) References Cited

U.S. PATENT DOCUMENTS 3,889,163 A * 6/1975 Symmes ..... 361/232
4,965,553 A * 10/1990 DelBiondo et al. ..... 340/573.1
6,567,785 B1 * 5/2003 Clendenon ..... 705/11
6,762,687 B1 * 7/2004 Perlman ..... 340/573.1

* cited by examiner

*Primary Examiner*—Toan N. Pham
(74) *Attorney, Agent, or Firm*—Steven G. Roeder

(57) ABSTRACT

A sensor assembly (10) for monitoring movement of an object (13) near a first body region (11) of an animal (12) includes one or more sensors (16) and a signaling unit (24). The sensor (16) is coupled to the animal (12) and detects movement of the object (13) near the first body region (11) of the animal (12). The signaling unit (24) generates a sensory signal that is received by the animal (12) when the sensor (16) detects movement of the object (13) near the first body region (11). In one embodiment, the sensor (16) can include an infrared sensor. Alternatively, one or more of the sensors (16) can include a directional sensor, a positional sensor, an inclination sensor and/or another suitable type of sensor (16). The sensory signal can be an audible sound, a vibration, a visual signal and/or an electrical impulse. The sensor assembly (10) can also include a counter (26) that monitors the number of times that the sensor (16) detects movement of the object (13) within or near the first body region (11).

40 Claims, 2 Drawing Sheets

DEVICE AND METHOD FOR PREVENTING UPPER RESPIRATORY DISEASES AND FOR MODIFYING CERTAIN OCD BEHAVIORS

RELATED APPLICATION

This Application claims the benefit on U.S. Provisional Application Serial No. 60/446,901 filed on Feb. 12, 2003. The contents of U.S. Provisional Application Serial No. 60/446,901 are incorporated herein by reference.

FIELD OF THE INVENTION

The present invention relates generally to a device and method that can be used to inhibit the occurrence of upper respiratory infections and/or detect and assist in modifying certain obsessive-compulsive disorder (OCD) behaviors.

BACKGROUND

It is generally accepted that extremity-to-face contact is a primary means of transmitting upper respiratory infection diseases. For example, one or more viruses can be collected on the hand when touching contaminated surfaces such as doorknobs, shopping carts, pens, other hands, etc. Generally speaking, viruses can survive from a few hours to as long as four days or more on nonporous surfaces, and for at least two hours on human skin. Over the course of a day, an individual may contact several contaminated surfaces and may subsequently touch his or her face up to 100 times or more. Such extremity-to-face contact increases the likelihood that a virus will ultimately reach the mucus membranes of the mouth, nose, eyes, etc., resulting in a serious disease or other illness being contracted by the individual.

Unfortunately, attempts to prevent spreading of respiratory diseases and other viruses have not been altogether satisfactory. For example, in the case of human beings, vaccines are commonly used to inhibit contracting and spreading of various influenza viruses. Regrettably, because these types of vaccines only account for a limited number of existing strains of the influenza virus, they are not entirely effective. Other attempts to control spreading of communicable diseases include the use of protective devices such as masks and eye goggles. However, such devices can be cumbersome and have not been completely well-received even by individuals in high-risk work environments such as hospitals and schools.

Additionally, trichotillomania is a condition that affects up to approximately 2% of the human population. Trichotillomania is characterized by the habitual pulling out of one's eyebrows, eyelashes, or hair. Two current methods of treatment are behavioral therapy and the use of medication. Behavioral therapy is often considered to be more preferred than medications because of the lack of potential side effects or contraindications. Current behavioral therapy tools can rely on a patient to count and record the number of occurrences of the undesirable behavior, which can result in inaccuracies. Other devices that are not completely effective may only passively remind the patient not to engage in the particular behavior. In addition, the efficacy of certain medications can decrease over a relatively short, continuous period of time.

SUMMARY

The present invention is directed to a sensor assembly for monitoring movement of an object near a first body region of an animal, including a human being. In one embodiment, the sensor assembly includes one or more sensors and a signaling unit. The sensor can be coupled to the animal and can detect movement of the object near a head-neck region of the animal. The signaling unit generates a sensory signal that is received by the animal when the sensor detects movement of the object near the head-neck region. For example, the object to be detected can be an extremity of the animal. Alternatively, the object can be secured to an extremity of the animal or to another suitable body region of the animal.

In one embodiment, the sensor can include an infrared sensor. Alternatively, the one or more sensors can include a directional sensor, a positional sensor, an inclination sensor and/or another suitable type of sensor. In alternative, non-exclusive embodiments, the sensor can be positioned on or near a chest region, a neck region, the extremity and/or on or near another body region of the animal.

The sensory signal emitted by the signaling unit can be an audible sound, a vibration, a visual signal, an electrical impulse, or another type of stimulus.

In an alternative embodiment, the sensor assembly can include a counter instead of or in addition to the signaling unit. The counter can monitor the number of times that the sensor detects movement of the object near a specific body region of the animal and/or the number of times that the signaling unit signals the animal that the object is near a specific body region of the animal. In one embodiment, the sensory signal varies from one occurrence to another.

The present invention is also directed to a method for monitoring movement of an object near a particular body region of an animal.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
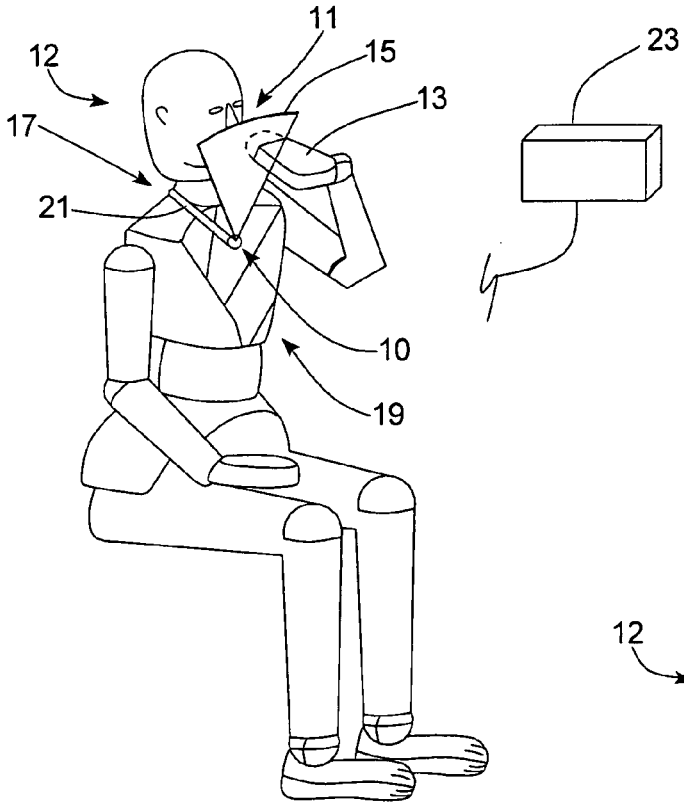
FIG. 1A is a perspective view of an animal using a first embodiment of a sensor assembly having features of the present invention.

FIG. 1A is a perspective view of a first embodiment of a sensor assembly 10 having features of the present invention and an animal 12 utilizing the sensor assembly 10. As used herein, the term "animal" is intended to include any mammal, reptile, or other appropriate vertebrate animal. As non-exclusive examples, the animal 12 can be a human being, a dog or a cat.

As an overview, the sensor assembly 10 generally monitors and/or inhibits contact between a first body region 11 and an object 13 (also referred to herein as a "second body region"). Although the sensor assembly 10 can be utilized in many ways as described herein, the sensor assembly 10 is particularly useful in monitoring and/or inhibiting contact between the hand(s) and the face of a human being in order to prevent transmission of respiratory diseases, and to control or alter certain obsessive-compulsive behavior disorders.

In the embodiment illustrated in FIG. 1A, the first body region 11 can be a head-neck region. However, it is recognized that the first body region 11 can be any relevant portion or region of the animal 12. For example, the first body region 11 can be a face, a head, an ear, a surgical incision site or an injured region such as a wound on the animal 12, as non-exclusive examples.

The object 13 can be any portion of the animal 12 other than the first body region 11. In the embodiment illustrated in FIG. 1A, the object 13 can be an extremity of the animal 12. As used herein, the extremity is intended to mean any limb or other appendage on the body of the animal 12. In the case of a human being, the extremity can include a hand, a finger, a portion of an arm, a foot, or a portion of a leg, as non-exclusive examples. Alternatively, the object 13 can be a body region of another animal. Still alternatively, the object 13 can be an inanimate object not necessarily connected to the animal 12. However, in each embodiment described herein, the object 13 is something that is physically tangible and has a mass.

In the embodiment illustrated in FIG. 1A, the sensor assembly 10 can emit a sensor pattern 15, which when penetrated by the object 13, causes a sensory stimulus to the animal 12. The design of the sensor assembly 10 can be varied to suit the requirements of the animal 12. In the embodiment illustrated in FIG. 1A, at least a portion of the sensor assembly 10 is worn at or near a neck region 17 or a chest region 19 of the animal 12.

In one embodiment, the sensor assembly 10 is coupled to the animal 12 with an attacher 21. The attacher 21 can be a pin, a strap, a necklace, a hook and loop type fastener, an adhesive material, a suction means or any other suitable means of coupling the sensor assembly 10 to the animal 12. In alternative embodiments, one or more portions of the sensor assembly 10 can be attached on the outside or underneath the clothing of the animal 12, such as on a belt, shirt, jacket, or any other article of clothing worn by the animal 12. In still another embodiment, at least a portion of the sensor assembly 10 can be worn on a band 332 (illustrated in FIG. 3) around the wrist or on another body region of the animal 12, or can be attached to a tool or other item carried or worn by the animal 12, such as a stethoscope, a badge, or jewelry in the case of a human being.

The shape of the sensor assembly 10 can vary. For example, the sensor assembly 10 can be round, square, rectangular, disc-shaped, or can have any other suitable configuration. The size of the sensor assembly 10 can vary depending upon the size of the particular area to be monitored by the sensor assembly 10 and/or for aesthetic reasons.

Additionally, the sensor assembly 10 can include a computer 23 that interfaces with other structures of the sensor assembly 10 to monitor, compile, assimilate, store, receive and/or provide data or other information from or to the other structures of the sensor assembly 10.

Figure 1B:
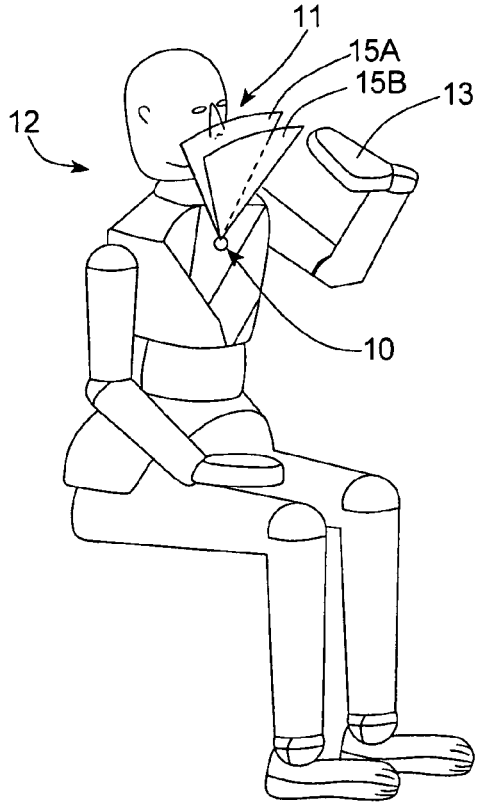
FIG. 1B is a perspective view of an animal using a second embodiment of the sensor assembly having features of the present invention.

FIG. 1B illustrates a second embodiment of the sensor assembly 10. In this embodiment, the sensor assembly emits a first sensor pattern 15A and a second sensor pattern 15B. As illustrated in FIG. 1B, the first sensor pattern 15A is emitted to be positioned more proximate the first body region 11 of the animal 12, while the second sensor pattern 15B is emitted to be positioned more distant from the first body region 11 of the animal 12. With this design, the sensor assembly can discern between movements by the first body region 11 of the animal 12 that result in the first sensor pattern 15A being penetrated (as illustrated in FIG. 1B) and movements that result in the object 13 penetrating the second sensor pattern 15B. For example, the sensor assembly 10 may be set to inhibit movements that penetrate only the more distant, second sensor pattern 15B, as opposed to movement by the first body region 11 that may penetrate the first sensor pattern 15A, and may be considered a "false alarm". Alternatively, both types of movements can be monitored by the sensor assembly 10.

Figure 2:
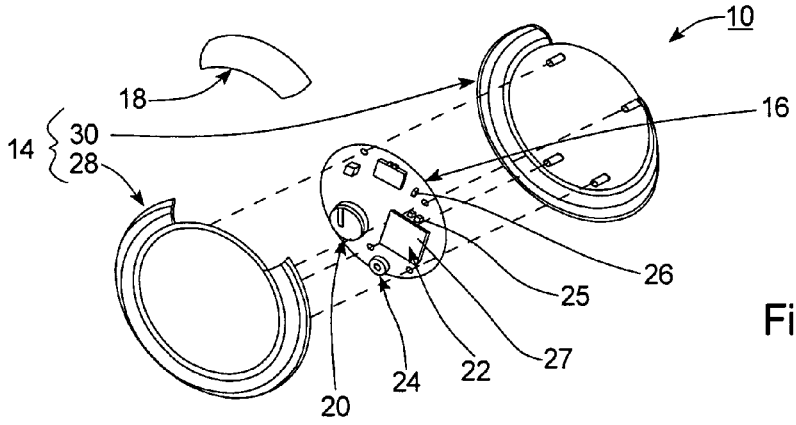
FIG. 2 is a detailed exploded view of a first embodiment of the sensor assembly having features of the present invention.

FIG. 2 is a detailed view of the sensor assembly 10 illustrated in FIG. 1A. In this embodiment, the sensor assembly 10 includes a housing 14, one or more sensors 16, a lens assembly 18, a power source 20, a controller 22, a signaling unit 24 and a counter 26. Although each of these components is illustrated in FIG. 2, it is recognized that not all of these components are required for the sensor assembly 10 to efficiently function, and that one or more of these components can be omitted from the sensor assembly 10 without impeding the functionality of the sensor assembly 10.

The housing 14 encircles and/or encloses one or more of the other components of the sensor assembly 10. The shape and size of the housing 14 can vary depending upon the design requirements of the sensor assembly 10. The housing 14 can be formed from various rigid or non-rigid materials such as plastics, metals, ceramics, epoxy resins, or any other suitable material. In one embodiment, the housing 14 can have one or more sections including a front section 28 and a rear section 30 that can be temporarily or permanently secured together to enclose and protect at least some of the other components of the sensor assembly 10. In the embodiment illustrated in FIG. 2, the sections 28, 30 of the housing 14 can be disassembled to allow access to the components within the housing 14. Additionally, the aesthetic appearance of the housing 14 can be varied in accordance with the apparel worn by the animal 12 (illustrated in FIG. 1A). Alternatively, the housing 14 can include greater or fewer than two sections 28, 30.

In one embodiment, the sensor 16 cooperates with the lens assembly 18 to detect whether an object 13 (illustrated in FIG. 1A) has moved to near or adjacent to the first body region 11 (illustrated in FIG. 1A) of the animal 12. The type of sensor 16 that can be used in the sensor assembly 10 can vary. For example, the sensor 16 can include an infrared sensor such as an infrared emitting diode (IRED) or another type of infrared sensor. The sensor 16 can detect an obstruction to a signal or rays emitted by the sensor 16 once an object 13 moves to within a predetermined distance of the sensor 16 or an area monitored by the sensor 16. With this type of sensor 16, changes in infrared radiation, reflection of infrared radiation back to the sensor 16, and/or changes in temperature in a specified area can be detected and/or monitored in a non-contact manner, for example.

In one embodiment, the sensor 16 can emit one or more signals in a sensor pattern 15 (illustrated in FIG. 1A, for example) which can be a specified distance away from the first body region 11 of the animal 12, such as approximately six inches. Importantly, the specified distance can be greater or less than six inches depending upon the reaction time requirements of the animal 12 and/or other relevant factors. In alternative, non-exclusive examples, the specified distance can be 1, 2, 3, 4, 5, 7, 8, 9, 10 or 12 inches.

Moreover, the sensor pattern 15 can be planar, can have a curved configuration, or another suitable configuration. In another embodiment, the sensor 16 can monitor movement that occurs within a predetermined distance from the face, from the first body region 11 or from another body region of the animal 12. In one example, the sensor 16 can emit visible or invisible rays generally from the chest region 19 (illustrated in FIG. 1A) of the animal 12 in a direction toward the first body region 11. With this design, a triggering field of a desired configuration is emitted and thereby positioned a suitable distance from the first body region 11, such as between the first body region 11 and one or more extremities of the animal 12, as explained in greater detail below.

It is recognized that alternative types of sensors 16 can be used with the present invention. For instance, in alternative embodiments, the sensor 16 can include an ultrasonic sensor, an ultraviolet sensor, a Hall-effect sensor, a capacitive sensor, an inductive sensor, a magnetic sensor, a laser sensor, a heat or temperature sensitive sensor, or an inclination sensor, as non-exclusive examples. Stated another way, the sensor 16 can detect changes in proximity, distance, position, direction, rotation, velocity, and/or acceleration of an object 13 relative to one or more body regions of the animal 12, or relative to another sensor (not shown in FIG. 2).

The lens assembly 18 can determine one or more locations that the sensor 16 monitors. In other words, in the example of an infrared sensor 16, the lens assembly 18 can focus and/or guide the direction of the sensor 16 to detect movement within one or more specific positions or sensor patterns 15 relative to the first body region 11 of the animal 12, or relative to another location. For example, the object 13 can reflect infrared radiation or another wavelength back to the origin of the sensor 16 or another position in order to detect movement at or near one or more sensor patterns 15. In another example, the lens assembly 18 can shape, divert, orient, redirect and/or diffuse the sensor pattern 15 in the desired manner. In one embodiment, the lens assembly 18 includes a Fresnel lens. However, it is recognized that any suitable lens can be used with the lens assembly 18.

The power source 20 provides power to one or more components of the sensor assembly 10, including the sensor 16, the controller 22 and/or the signaling unit 24, as non-exclusive examples. The type of power source 20 can vary depending upon the design requirements of the sensor assembly 10. In one embodiment, the power source 20 can include a battery that stores power. In an alternative embodiment, the power source 20 can be a capacitor or another suitable type of power storage unit.

The controller 22 can process information received by the sensor 16. Additionally, the controller 22 can determine when to direct current to the signaling unit 24, as described in greater detail below. The type of controller 22 included in the sensor assembly 10 can vary. In one embodiment, the controller can include a microprocessor. However, other suitable types of controllers 22 can be utilized with the present invention. In one embodiment, the controller 22 can decrease the incidence of erroneously directing current to the signaling unit 24, e.g., a false alarm, as explained relative to the embodiment illustrated in FIG. 1B.

In one embodiment, the controller 22 can include a clock device 27 that can track the timing (i.e. duration and/or time of day) of when the sensor pattern 15 has been interrupted or penetrated. For example, the clock device 27 can monitor the duration of a specific penetration of the sensor pattern 15 by the object 13. Further, in the embodiment illustrated in FIG. 1B, based on the timing of penetration of the first sensor pattern 15A and the second sensor pattern 15B, and the distance between the sensor patterns 15A, 15B, the controller 22 can determine the speed of the approaching object 13.

The signaling unit 24 alerts the animal 12 when an object 13 such as one or the extremities of the animal 12, or another object 13 has disturbed or penetrated the signal or rays emitted by the sensor 16, thereby monitoring the first body region 11 or other relevant body region. For example, by alerting the animal 12 that an object 13 is moving in the direction of the animal's first body region 11, or more specifically, close to the face of the animal 12, the animal 12 can be alerted to adjust, reroute, impede or otherwise disrupt the current motion and inhibit contact between the object 13 and the first body region 11 of the animal 12. With this design, the animal 12 is provided with enough notice to take evasive action to inhibit extremity-to-face contact, for example, and thereby reduce the likelihood of spreading a virus or bacteria to the mucous membranes in the facial area of the animal 12, or thereby inhibiting a certain undesired behavioral pattern of the animal 12.

The specific type of signaling unit 24 included in the sensor assembly 10 can vary depending upon the needs of the animal 12. For example, the signaling unit 24 can emit a continuous audible response once directed by the controller 22 to do so. Upon hearing the audible response, the animal 12 is alerted that his or her extremity may imminently be contacting the first body region 11. With this design, the animal 12 can respond by altering the motion of the extremity by moving the extremity away from the first body region 11, which can discontinue the audible response of the signaling unit 24. In an alternative embodiment, the signaling unit 24 can emit a one-time audible response. In still other embodiments, the signaling unit 24 can signal the animal 12 by other sensory means, such as by using vibration, electrical impulses or visible light, as non-exclusive examples.

Additionally, in the embodiment illustrated in FIG. 2, the sensor assembly 10 can include one or more amplifiers 25 that can amplify the signal emitted from the sensor 16, and/or can amplify the sensory signal output of the signaling unit 24 (up to or beyond a required decibel level, for example) to ensure better communication to the animal 12.

The counter 26 monitors and/or counts the number of times that the signaling unit 24 has been activated due to an object 13 penetrating or otherwise moving near the first body region 11, as determined by the sensor 16. The type of counter 26 can vary. In one embodiment, the counter 26 includes a digital readout that can be read by the animal 12 using the sensor assembly 10 or by a doctor, veterinarian or other health care provider. In one embodiment, the counter 26 is used in conjunction with the signaling unit 24. In an alternative embodiment, the counter 26 is used without the signaling unit 24. In still another embodiment, the counter 26 is omitted from the sensor assembly 10.

In one embodiment, the sensor assembly 10 can include or can be connected to an interface (not shown) that is used to upload data from the controller 22 regarding the number of times the signaling unit 24 has been activated over time to a computer 23 (illustrated in FIG. 1A) or other suitable device for statistical data analyses, a system of devices that are monitored holistically, archiving, etc. In one embodiment, for example, the computer 23 can generate a histogram that graphically illustrates the timing, frequency and duration of the activation of the signaling unit 24.

Figure 3:
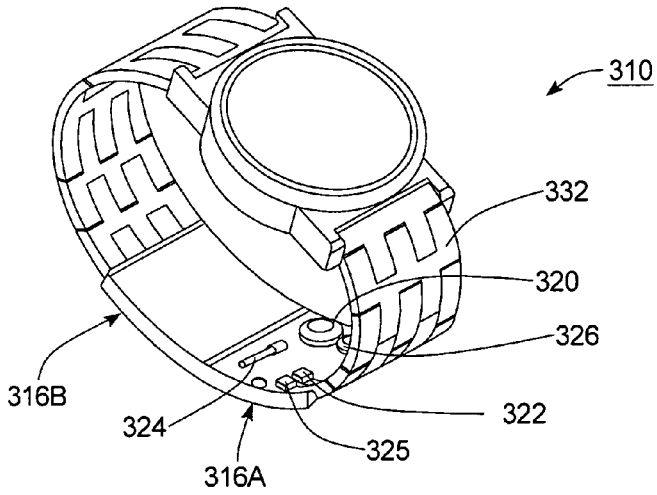
FIG. 3 is a perspective view of a second embodiment of a sensor assembly having features of the present invention.

FIG. 3 illustrates another embodiment of the sensor assembly 310. As illustrated in FIG. 3, the sensor assembly 310 is positioned on or within a wristband 332 that is worn by the animal 12 (illustrated in FIG. 1). In this embodiment, the sensor assembly 310 can include one or more sensors including a first sensor 316A and a second sensor 316B. Further, in the embodiment illustrated in FIG. 3, the sensor assembly 310 can include one or more of a power source 320, a controller 322, a signaling unit 324, one or more amplifiers 325 and a counter 326.

Figure 4:
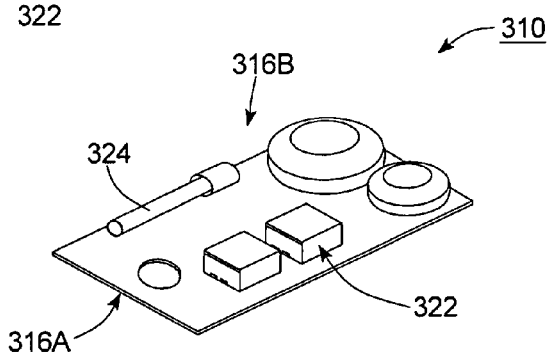
FIG. 4 is a detailed perspective view of a portion of the sensor assembly illustrated in FIG. 3.

FIG. 4 is a detailed view of one embodiment of a portion of the sensor assembly 310 illustrated in FIG. 3. In this embodiment, the first sensor 316A is a proximity sensor and the second sensor 316B is an inclination sensor. These sensors 316A, 316B can cooperate to provide information to the controller 322 for processing. The controller 322 can then use this information to determine whether current should be directed to the signaling unit 324 to emit a sensory signal to the animal 12 (illustrated in FIG. 1) to notify the animal 12 that contact with the first body region 11 (illustrated in FIG. 1) of the animal 12 may be imminent.

In this embodiment, the proximity sensor 316A can detect when the sensor 316A is within a predetermined distance from another object, such as the first body region 11 of an animal 12. Alternatively, the proximity sensor 316A can detect when the sensor 316A has moved to within a specified distance of a material having one or more specific properties, such as plastic, glass, metal, or other materials that may be positioned at or near the first body region 11, for example. Alternatively, the proximity sensor 316A can detect when the sensor penetrates an emitted sensor pattern 15 (illustrated in FIG. 1) of another sensor, such as an infrared sensor or another type of sensor that emits a sensor pattern 15.

The inclination sensor 316B can monitor one or more of (i) the absolute slope and/or angle of inclination of the sensor 316B, and (ii) the change in the slope and/or angle of inclination of the sensor 316B. This information can then be transmitted to the controller 322 for processing in order to determine whether the signaling unit 324 should emit a signal to the animal 12 to inhibit further movement by the animal 12.

In alternative embodiments, the first sensor 316A and the second sensor 316B can be other suitable types of sensors as previously described. Still alternatively, greater than two sensors 316A, 316B can be used in the sensor assembly 310.

In yet another embodiment, the sensor assembly 10 can include one or more sensors and a separate activating material positioned elsewhere on the animal 12, such as on or near another body region. As an example, a first sensor can emit a beam having a specific wavelength and can be worn at or near the chest region 19 (illustrated in FIG. 1). The activating material can be a reflective surface worn on the wrist or other extremity of the animal 12 which would interrupt or otherwise disturb the beam emitted by the sensor. The sensor sends this information to the controller which processes the information and activates the signaling unit 24 to warn the animal 12 of the extremity location of the animal 12.

Moreover, with one or more of the embodiments described herein, a number of different sensory signals can be used which can vary from one event to the next. For example, in the case of an audible sensory signal, the frequency, duration and/or decibel level of the auditory signal can vary from one occurrence to the next. In the case of a vibratory sensory signal, the frequency, duration and/or amplitude of the vibration can be made to vary from one occurrence to the next, and so on. Thus, the likelihood that the animal 12 will become overly accustomed to a particular type of sound, vibration, wavelength of light, or other stimulus is decreased.

With these designs, the sensor assembly 10 can reduce the incidence of extremity-to-face contact by the animal 12. Thus, the likelihood that viruses, bacteria and/or other microorganisms will be transmitted from the extremities to the face, including the eyes, nose and mouth, is decreased. As a consequence, the opportunities for the animal 12 to contract one or more diseases are fewer.

Additionally, the sensor assembly 10 can modify or reverse undesirable behavior, such as trichotillomania, nail-biting, etc. Further, although the sensor assembly 10 as described herein is particularly useful for human beings, it is recognized that the sensor assembly 10 can effectively be utilized with domesticated or non-domesticated animals. Basically, any undesirable behavior involving contact between the first body region 11 and the second body region 13 or other object 13 can be monitored and/or inhibited using the sensor assembly 10 described herein.

While the particular sensory assembly 10 as shown and disclosed herein is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A sensor assembly for monitoring movement of a hand or an arm of a person near a head-neck region of the person, the sensor assembly comprising:

a sensor that is positioned near the head-neck region of the person, the sensor emitting a beam and detecting when the beam is interrupted by the movement of at least one of the hand and the arm near the head-neck region of the person; and a signaling unit that generates a sensory signal that is received by the person when the sensor detects that the beam is interrupted.

2. The sensor assembly of claim 1 wherein sensor detects when an arm of the person interrupts the beam.

3. The sensor assembly of claim 1 wherein the sensory signal is a signal selected from the group consisting of an audible signal, a vibratory signal and a visual signal.

4. The sensor assembly of claim 1 wherein the sensor is secured to the person.

5. The sensor assembly of claim 1 wherein the sensor is contained in a single housing.

6. The sensor assembly of claim 1 further comprising a counter that monitors the number of times that the sensor detects movement of the object near the head-neck region.

7. The sensor assembly of claim 1 wherein the sensor generates a plurality of beams positioned in a first pattern which is a specified distance away from the head-neck region of the person and the sensor detects when one or more of the beams is interrupted by the hand.

8. The sensor assembly of claim 7 wherein the sensor generates a plurality of second beams positioned in a second pattern which is spaced apart from the first pattern, and the sensor detects when one or more of the second beams is interrupted by the hand.

9. The sensor assembly of claim 8 wherein the first pattern is closer to the head-neck region than the second pattern.

10. The sensor assembly of claim 7 wherein the first pattern is substantially planar shaped.

11. A sensor assembly for monitoring movement of an object near a head-neck region of an animal, the sensor assembly comprising:

a sensor that emits a beam and that detects when the beam is interrupted by the movement of the object near the head-neck region of the animal; and a counter that monitors the number of times that the sensor detects that the beam is interrupted.

12. The sensor assembly of claim 11 wherein the object is a body region of the animal.

13. The sensor assembly of claim 11 further comprising a signaling unit that generates a sensory signal that is received by the animal when the sensor detects that the beam is interrupted, wherein the sensory signal is a signal selected from the group consisting of an audible signal, a vibratory signal and a visual signal.

14. The sensor assembly of claim 11 wherein the sensor is secured to the animal and is positioned near a chest region of the animal.

15. The sensor assembly of claim 11 wherein the sensor is secured to an extremity of the animal.

16. The sensor assembly of claim 11 wherein the sensor generates a plurality of beams positioned in a first pattern which is a specified distance away from the head-neck region of the animal and the sensor detects when one or more of the beams is interrupted by the object.

17. The sensor assembly of claim 16 wherein the sensor generates a plurality of second beams positioned in a second pattern which is spaced apart from the first pattern, and the sensor detects when one or more of the second beams is interrupted by the object.

18. The sensor assembly of claim 17 wherein the first pattern is closer to the head-neck region than the second pattern.

19. The sensor assembly of claim 16 wherein the first pattern is substantially planar shaped.

20. A sensor assembly for monitoring movement of an object near a head-neck region of a person, the sensor assembly comprising:

a sensor that emits a plurality of beams positioned in a first pattern which is a specified distance away from the head-neck region of the person and the sensor detects when one or more of the beams is interrupted by the object, the sensor being secured to the person; and a signaling unit that generates a sensory signal that is received by the person when the sensor detects that one or more of the beams is interrupted.

21. The sensor assembly of claim 20 wherein the object is a body region of the animal.

22. The sensor assembly of claim 20 wherein the sensory signal is a signal selected from the group consisting of an audible signal, a vibratory signal and a visual signal.

23. The sensor assembly of claim 20 wherein the sensor is positioned near a chest region of the person.

24. The sensor assembly of claim 20 further comprising a counter that monitors the number of times that the sensor detects movement of the object near the head-neck region.

25. The sensor assembly of claim 20 wherein the sensor generates a plurality of second beams positioned in a second pattern which is spaced apart from the first pattern, and the sensor detects when one or more of the second beams is interrupted by the object.

26. The sensor assembly of claim 25 wherein the first pattern is closer to the head-neck region than the second pattern.

27. The sensor assembly of claim 20 wherein the first pattern is substantially planar shaped.

28. A method for monitoring movement of a hand or an arm of a person near a head-neck region of the person, the method comprising the steps of:

positioning a sensor that detects movement of the hand near the head-neck region, the sensor emitting a beam and detecting when the beam is interrupted by the movement of at least one of the hand and the arm near the head-neck region of the person; and generating a sensory signal that is received by the person when the sensor detects that the beam is interrupted.

29. The method of claim 28 wherein the step of generating a sensory signal includes generating a signal selected from the group consisting of an audible signal, a vibratory signal and a visual signal.

30. The method of claim 28 wherein the step of positioning includes the step of securing the sensor to the person near a chest region of the person.

31. The method of claim 28 further comprising the step of counting the number of times that the sensor detects movement of the hand near the head-neck region with a counter.

32. The method of claim 28 wherein the step of positioning includes the step of the sensor generating a plurality of beams positioned in a first pattern which is a specified distance away from the head-neck region of the person and the step of the sensor detecting when one or more of the beams is interrupted by the hand.

33. The method of claim 32 wherein the step of positioning includes the step of the sensor generating a plurality of second beams positioned in a second pattern which is spaced apart from the first pattern, and the step of the sensor detecting when one or more of the second beams is interrupted by the hand.

34. A method for monitoring movement of an object near a first body region of an animal, the method comprising the steps of:

positioning a sensor that detects movement of the object near the first body region, the sensor emitting a beam and detecting when the beam is interrupted by the movement of the object near the head-neck region of the animal; and counting the number of times that the sensor detects that the beam is interrupted with a counter.

35. The method of claim 34 further comprising the step of generating a sensory signal when the sensor detects that the beam is interrupted, the sensory signal being selected from the group consisting of an audible signal, a vibratory signal and a visual signal.

36. The method of claim 34 wherein the step of positioning includes the step of securing the sensor to the animal near a chest region of the animal.

37. The method of claim 34 wherein the step of positioning includes the step of the sensor generating a plurality of beams positioned in a first pattern which is a specified distance away from the head-neck region of the animal and the step of the sensor detecting when one or more of the beams is interrupted by the object.

38. The method of claim 34 wherein the step of positioning includes the step of the sensor generating a plurality of second beams positioned in a second pattern which is spaced apart from the first pattern, and the step of the sensor detecting when one or more of the second beams is interrupted by the object.

39. A method for monitoring movement of an object near a head-neck region of a person, the method comprising the steps of:

positioning a sensor that detects movement of the object near the head-neck region, the sensor emitting a plurality of beams positioned in a first pattern which is a specified distance away from the head-neck region of the person and the sensor detects when one or more of the beams is interrupted by the object, the sensor be secured to the person; and generating a sensory signal that is received by the person when the sensor detects that the one or more of the beams is interrupted.

40. The method of claim 39 wherein the step of positioning includes the step of the sensor generating a plurality of second beams positioned in a second pattern which is spaced apart from the first pattern, and, the step of the sensor detecting when one or more of the second beams is interrupted by the object.

* * * * *